US009423176B1

(12) United States Patent
Girardi

(10) Patent No.: US 9,423,176 B1
(45) Date of Patent: Aug. 23, 2016

(54) SYSTEM FOR BALANCING LUMBER KILN RETURN AIR

(71) Applicant: KILN DRYING SYSTEMS & COMPONENTS, INC., Arden, NC (US)

(72) Inventor: Robert Girardi, Arden, NC (US)

(73) Assignee: Kiln Drying Systems & Components, Inc., Hendersonville, NC (US)

( * ) Notice: Subject to any disclaimer, the term of this patent is extended or adjusted under 35 U.S.C. 154(b) by 491 days.

(21) Appl. No.: 13/841,716

(22) Filed: Mar. 15, 2013

Related U.S. Application Data

(60) Provisional application No. 61/684,273, filed on Aug. 17, 2012.

(51) Int. Cl.
*F26B 25/06* (2006.01)
*F26B 19/00* (2006.01)
*F26B 3/02* (2006.01)

(52) U.S. Cl.
CPC ..... *F26B 3/02* (2013.01)

(58) Field of Classification Search
CPC ..... F26B 2210/16
USPC ..... 34/201, 219, 231, 232, 205, 207, 209, 34/210, 212, 215, 218, 223–225, 233; 425/231, 234, 235; 454/231, 234, 235; 432/30, 176, 199
See application file for complete search history.

(56) References Cited

U.S. PATENT DOCUMENTS 1,885,418 A * 11/1932 Darrah ..... 432/145
2,718,713 A * 9/1955 Bloxham ..... 34/223
3,422,545 A 1/1969 Wilson
4,098,008 A 7/1978 Schuette
4,432,147 A 2/1984 Chen
4,830,095 A * 5/1989 Friend ..... 165/208
4,972,604 A 11/1990 Breckenridge
5,050,314 A 9/1991 Breckenridge
5,269,076 A * 12/1993 Breckenridge ..... 34/413
5,414,944 A 5/1995 Culp
5,416,985 A 5/1995 Culp
5,437,109 A 8/1995 Culp
5,488,785 A 2/1996 Culp
5,595,000 A * 1/1997 Goodwin, III ..... F26B 21/086 34/212
6,209,223 B1 * 4/2001 Dinh ..... F26B 17/1416 34/167
6,219,937 B1 4/2001 Culp
6,370,792 B1 4/2002 Culp (Continued)

OTHER PUBLICATIONS

Boone & Simpson, Chapter 02 Kiln Types and Features-USDA Agricultural Handbook AH-188: Dry Kiln Operator's Manual, 2001, 31 pages, USDA, found at http://www.fpl.fs.fed.us/documnts/usda/ah188/chapter02.pdf.

(Continued)

*Primary Examiner* — Kenneth Rinehart
*Assistant Examiner* — John McCormack
(74) *Attorney, Agent, or Firm* — Kevin E. Flynn; Flynn IP Law

(57) ABSTRACT

An apparatus that employs dual air ducts is described for balancing the return air flow between forward and reverse fan directions in a direct-fired lumber kiln. As freshly heated air enters the kiln, this system forces the air to pass through the stacks of lumber at least once before returning to be reheated. The disclosed apparatus and methods enable more efficient use of energy, reduce drying time and improve the uniformity and precision of the lumber drying process.

28 Claims, 13 Drawing Sheets

(56) References Cited

U.S. PATENT DOCUMENTS

| | | | | |
|---|---|---|---|---|
| 6,393,723 | B1 | 5/2002 | Nagel | |
| 6,467,190 | B2 | 10/2002 | Nagel | |
| 6,652,274 | B2 | 11/2003 | Nagel | |
| 7,963,048 | B2 | 6/2011 | Pollard | |
| 2002/0108266 | A1* | 8/2002 | Nagel | F26B 21/026 34/223 |
| 2007/0044341 | A1* | 3/2007 | Pollard | F26B 15/12 34/201 |
| 2010/0112500 | A1* | 5/2010 | Maiello et al. | 431/76 |

OTHER PUBLICATIONS

Progressive tunnel drying kilns-screen shot of web page on site maintained by Katres Ltd.; as shown Jul. 6, 2013 at http://www.katres.cz/en/products/progressive-tunnel-kilns/ showing longitudinal cross section of a kiln and related airflows.

Giroux, Paul, Kiln Fans-From Design to Optimizing Performance, Western Dry Kiln Association Meeting 2004, May 2004, 5 pages, Western Dry Kiln Association, Portland Oregon.

* cited by examiner

300

300

300

600

600

2300

2300

3300

3300

SYSTEM FOR BALANCING LUMBER KILN RETURN AIR

This application claims the benefit of U.S. Provisional Application No. 61/684,272 filed Aug. 17, 2012 and incorporates that application in its entirety.

FIELD OF THE DISCLOSURE

This disclosure applies to systems using direct fired heating systems for the drying of lumber in which the circulation direction of air inside a kiln is periodically reversed, including but not limited to continuous and batch kilns. The continuous drying kiln (CDK) design is one in which two paths of lumber travel in opposite directions through a sequence of chambers in which wood is preheated, dried, equalized and then conditioned. In batch kilns the lumber stays in the kiln without movement until fully treated.

FIG. 1 introduces a series of elements found in continuous drying kilns. Typically a continuous drying kiln will have a structure 104 with a first end 108 and a second end 112 at the opposite end of the structure 104. Running through the structure 104, is a first pathway 116 and a second pathway 120. The pathways frequently use rails 124 to guide a first set of carriages 128 along the first pathway 116 and a second set of carriages 132 along the second pathway 120. The carriages (128 132) may have wheels (not shown) much like those found on railroad cars.

If the first set of carriages 128 enters the structure 104 through the first end 108 and exits through the second end 112, then the second set of carriages 132 enters the structure 104 through the second end 112 and exits through the first end 108. Thus, when lumber 130 is stacked on the carriages (128 and 132) and exposed to heat in the main drying section 300, the heated lumber 136 passes near lumber that has not yet been in the main drying section 300 (green lumber 140). Note the simplified drawing in FIG. 1 shows the lumber as an essentially solid stack. This is not the case. Spacers (not shown) are placed across each layer of boards within each stack of lumber 130 to provide open area for air movement through the lumber stack 156. Weights on top of each lumber stack 156 provide restraint, minimize warping, and prevent boards from falling off of the top of the lumber stack 130. To minimize the air flow that might otherwise go over the top of the lumber stack 156 within the structure 104, structure 104 has longitudinal baffles (220 FIG. 2) that are aligned with the long axis of the structure 104 and thus aligned with the direction the lumber stacks travel through the kiln and orthogonal to the flow of air from the first side 144 to the second side 148 of the structure or to the flow of air from the second side 148 to the first side 144 of the structure 104. These overhead baffles 220 are designed to minimize the leakage of air between the fan deck (224 discussed below) and the top of the lumber 152, thus directing the air to flow through the air spaces between the layers of lumber 130 separated by spacers in the lumber stacks.

The heated lumber 136 passes heat to the green lumber 140 to partially heat and dry the green lumber 140 and the green lumber 140 cools the heated lumber 136 by absorbing heat and by evaporating the moisture content of the green lumber 140. Thus, lumber stack 156 starts as green lumber 140 stacked upon the first set of carriages 128 with spacers to allow for air flow amongst stacked lumber 136. As the first set of carriages 128 moves along the first pathway 116, the green lumber 140 is exposed to air that is circulating in the first end recovery section 310 within structure 100.

FIG. 2 shows a cross section of the first end recovery section 310, operating in a first circulation direction 204 as fans 200 push the air in the first circulation direction 204. The fans 200 operate in openings in a center fan wall 228 that extends above the fan deck 224. The center fan wall 228 helps promote circulation by having a high pressure side downstream of the fan 200 and a low pressure side upstream from the fan 200.

Having an appropriate pressure gradient from the high pressure side of the center fan wall 228 to the low pressure side will cause a desired distribution of circulating air amongst the stacked lumber across the two sets of carriages (128 and 132).

To reduce the variability between lumber 130 on the first side 144 and the second side 148 of the first set of carriages 132 or the second set of carriages 132, the fans 200 are periodically stopped and allowed to coast to a full stop. Then the fans 200 are operated in the reverse direction to push air in the second circulation direction as shown in FIG. 3. Now air that from the fans 200 enters the lumber on the first set of carriages 128 on the first side 144 then enters the lumber on the second set of carriages 132 on the first side 144 then exist on the second side 148. Normal practice is to reverse the fan direction about once every two to four hours. The period of running the fan in one direction is often called a fan cycle. Many structures include intermediate orthogonal baffles 320 within the energy recovery sections (310 and 340).

The first end 108, and second end 112 may have some level of orthogonal baffles to limit loss of heat, but the structure 104 is typically far from hermetically sealed as there is a need for water vapor to leave the structure 104 at the first end 108 and second end 112 often as visible fog.

Returning to the processing of lumber stack 156 stacked upon the first set of carriages 128, eventually, the lumber stack 156 progresses from the first end energy recovery section 310 through orthogonal baffles 324 to enter the main drying section 300.

The main drying section 300 is much like the energy recovery section 310 and 340 with a set of bidirectional fans 200 located above a fan deck 204 circulating air alternatively in the first circulation direction 204 and the second circulation direction 208. Longitudinal baffles 220 keep the circulating air from passing between the top of the lumber stacks 152 and the fan deck 204. In the main drying section 300, direct fired kilns require an additional circulation path to move air from the structure 104 to a mixing chamber where hot flue gas from a direct fired burner is mixed with the returning air from the structure 104 to create a mix within a prescribed temperature range.

This mix of heated air and flue gas is returned to the main drying section 300 to increase the temperature and decrease the humidity of the main drying section 300. A blower forces heated air leaving the mixing chamber into a distribution duct that extends the length of the main drying section 300. The distribution duct may release heated air in an upward direction through apertures in the top surfaces of the fan deck 224 or it may also release heated air in a downward direction through slotted vertical ducts, which are called downcomers, are located between the first pathway 116 and second pathway 120 below the fan deck 224. The apertures and downcomers may be tuned to promote uniform distribution of the heated air. The flue gas leaving the direct fire burner may be near 2000 degrees Fahrenheit but after mixing first with the return air from the structure 104, may return to the main drying section 300 at 450 degrees Fahrenheit which is nearly twice the main drying section set point air temperature which is often between 240 degrees Fahrenheit and 260 degrees Fahrenheit.

Eventually, lumber stack 156 stacked upon the first set of carriages 128 emerges from the main drying section 300 through orthogonal baffle 324 to enter the second end energy recovery section 340. Now the lumber is heated lumber 136 giving off heat and drying green lumber 140 on carriages 132 on the second pathway 120. The heated lumber 136 is exposed to air moving in the first circulation direction 310 and in the second circulation direction 320 as the bi-directional fans 200 are periodically turned off, allowed to coast to a stop, and then restarted in the opposite direction.

The lumber stack 156 emerges from the second end 112 and is eventually removed from the carriage 132.

Lumber on carriages 132 on the second pathway 120 receive the same sequence of treatments but travel in the opposite direction from the second end 112 to the first end 108.

In batch kilns, the entire process typically takes about 24 hours for a complete charge, including time to load and unload the kiln and to carry out clean up or routine maintenance. While the total process time for continuous kilns is typically on the order of 40 hours per lumber stack, the continuous process includes more even preheating and conditioning steps and produces significantly more board feet with fewer defects per year. Batch kilns are similar to continuous kilns in the essential ways in which operations are affected by pressure differentials caused by the interaction of fan reversals and the return air ducts required for direct fired heating systems. Most batch kilns are also similar in length to the middle drying sections of continuous kilns, about 100 feet long. Due to these similarities, many older batch kilns are currently being converted to continuous kilns through the process of extending the rail length inside a batch kiln and adding two end energy recovery sections on either side of the pre-existing batch structure.

FIG. 4 shows supply duct system for the main drying section 300. The operation of the supply duct system remains the same no matter whether the fans 200 are operated to cause air flow in the first circulation direction (204 FIG. 2) or the second circulation direction (208 FIG. 3). First pathway 116 with first set of carriages 128 and second pathway 120 with second set of carriages 132 convey lumber stacks 156 in opposite directions through the main drying section 300.

A return duct 1530 draws air from the main drying section 300 (as discussed below). A direct fired burner 1534 (represented here by a flame) feeds burner exhaust at approximately 2000 degrees Fahrenheit into a mixing chamber 1538 to provide a mix of burner exhaust with return air from the return air duct 1530 to provide an output supplied to the main drying section 1300 above the main drying section set point which is often between 240 degrees Fahrenheit and 260 degrees Fahrenheit. The heated air is supplied via the supply duct 1546 and distributed to the space between the fan deck 224 and the tops of the stacks of lumber 156 as indicated by arrows 246 before entering the main drying section 300 above the fan deck 224 through distribution vents 250. The air moving to and from the mixing chamber 1538 will be moved by a blower 1542 located after the mixing chamber 1538. As the operation of the supply duct system is not the subject of the present application, arrows showing the flow of supply air will not be included in subsequent figures in order to provide focus on the return ducts and relevant air flow.

FIG. 5 illustrates what is often called the forward direction. Fans 200 are operated to cause air flow in the a direction away from return air duct 1530, which is second circulation direction 208 as the mixing chamber is on the second side 148 rather than the first side 144 of main drying section 300. As fans 200 are forcing air towards the first side 144 away from the opening 1550 to the return duct 1530, there is a pressure gradient from the first side 144 to the second side 148 which causes the circulated air to pass through the spaced lumber on the first set of carriages 128 and the second set of carriages 132.

FIG. 6 illustrates what is often called the reverse direction fans 200 are operated to cause air flow towards the opening 1550 for the return air duct 1530 which in this case is the first direction 204 as the opening 1550 to the return air duct is on the second side 148 rather than the first side 144 of the main drying section. Note that the fans 200 create a pressure gradient which acts to move air across the lumber on the second set of carriages 132 and then across the lumber on the first set of carriages 128. However, unlike the forward direction shown in FIG. 5, in the reverse direction, the opening 1550 to the return duct 1530 is on the high pressure side of the fans 200. Thus, while there is a desire to provide equivalent treatment to lumber on the first side 144 of carriages with lumber on the second side 148 of carriages, it is difficult to replicate the forward direction pressure gradient along the length of the main drying section 300 when operating in the reverse direction.

FIG. 7 illustrates a prior art attempt to address the imbalances between forward direction and reverse direction by adding an external return duct 630 with second opening 650 on the opposite side of the array of fans 200 in center fan wall 228 and sets of carriages 128 and 132, from opening 1550 on return duct 1530. When operated in the forward direction (208 for this main drying section 600), a damper closes flow from external return duct 630. Note that external return duct 630 extends above structure roof 660 and travels back towards the return duct 1530 outside of the heated structure.

FIG. 8 shows the prior art solution from FIG. 7 operated in the reverse direction (204 for this main drying section 600). When the fans are operated to provide circulation direction 204, the high pressure to low pressure gradient runs from second side 148 to first side 144 across the second set of carriages 132 then the first set of carriages 128. In this mode, second opening 650 sends return air through external return duct 630 to return duct 1530 while opening 1550 is isolated by a damper (not shown).

Prior art attempts to have a second return duct for use with reverse fan operation with external return ducts such as external return duct 630 in FIG. 7 and FIG. 8 have been unacceptable. Such external overhead ducts required insulation and needed extensive structural support which made them costly to construct. External metal ducts also deteriorated rapidly from condensation induced corrosion.

Special return ducts placed under the structure 100 and under the first set of carriages 128 and the second set of carriages 132 to reach return duct 1530 have been tried (not shown here). The underground duct which would fill up with ground water and condensing moisture from the drying process. Especially in direct fired kilns with suspension burners or other means of wood waste combustion, underground ducts tended to fill up with ash and quickly become too clogged to perform, requiring an excessive number of maintenance shutdowns.

SUMMARY OF THE DISCLOSURE

The present disclosure teaches the use of a dual return duct (1) to consistently draw return air from the low pressure side of the fan wall for improved kiln operation, and (2) to remove the need for use of the return duct modulating damper to compensate for pressure imbalances between forward and reverse kiln fan cycles for improved operation of direct fired burners.

Aspects of the teachings contained within this disclosure are addressed in the claims submitted with this application upon filing. Rather than adding redundant restatements of the contents of the claims, these claims should be considered incorporated by reference into this summary.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provided below as one of skill in the art will recognize that inventive concepts illustrated in various examples can be combined together in order to address a specific application.

Other systems, methods, features and advantages of the disclosed teachings will be or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURE

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

DETAILED DESCRIPTION

The new in-kiln dual return duct designs described below keep the return air inside the warm structure 100 of the kiln to a great extent, reducing the length of the return duct between the structure and the mixing chamber. Other than for a brief transition from kiln structure 100 to the mixing chamber 1538, the in-kiln return duct will frequently not need a separate support structure. Since the majority of the in-kiln return duct will be incorporated into the existing structure 100 of the kiln that is associated with the center fan wall 228, it will cost less to build while resolving heat loss, pressure loss and corrosion problems exhibited by prior art dual-return designs.

Figure 9:
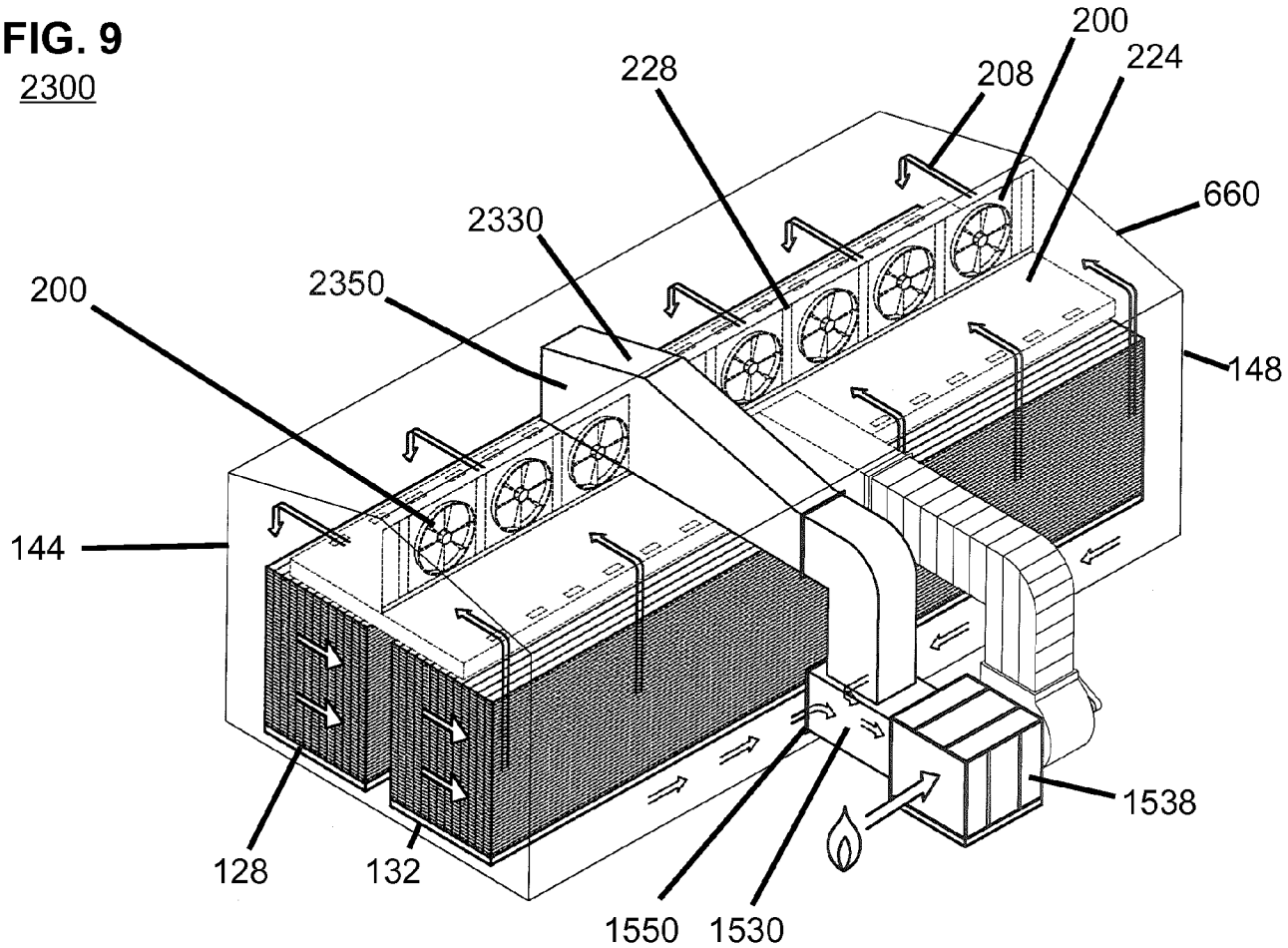
FIG. 9 show a modified main drying section with an internal second return duct as operated with forward air flow.

FIG. 9 shows an internal second return duct 2330 with opening 2350. Internal second return duct 2330 is placed above fan deck 224 but below roof 660. Internal second return duct 2330 crosses through an opening in center fan wall 228, perhaps by the omission of one or more fans 200 from the array of fans 200. However, the main drying section 2300 shown in FIG. 9 and FIG. 10 has decreased the distances between fans 200 to keep a full set of fans 200 while making room for internal second return duct 2330 to cross through the center fan wall 228. FIG. 9 shows operation in the forward direction (here 208) with return air entering opening 1550 to travel through return duct 1530 to mixing chamber 1538. A damper (not shown) isolates opening 2350.

Figure 10:
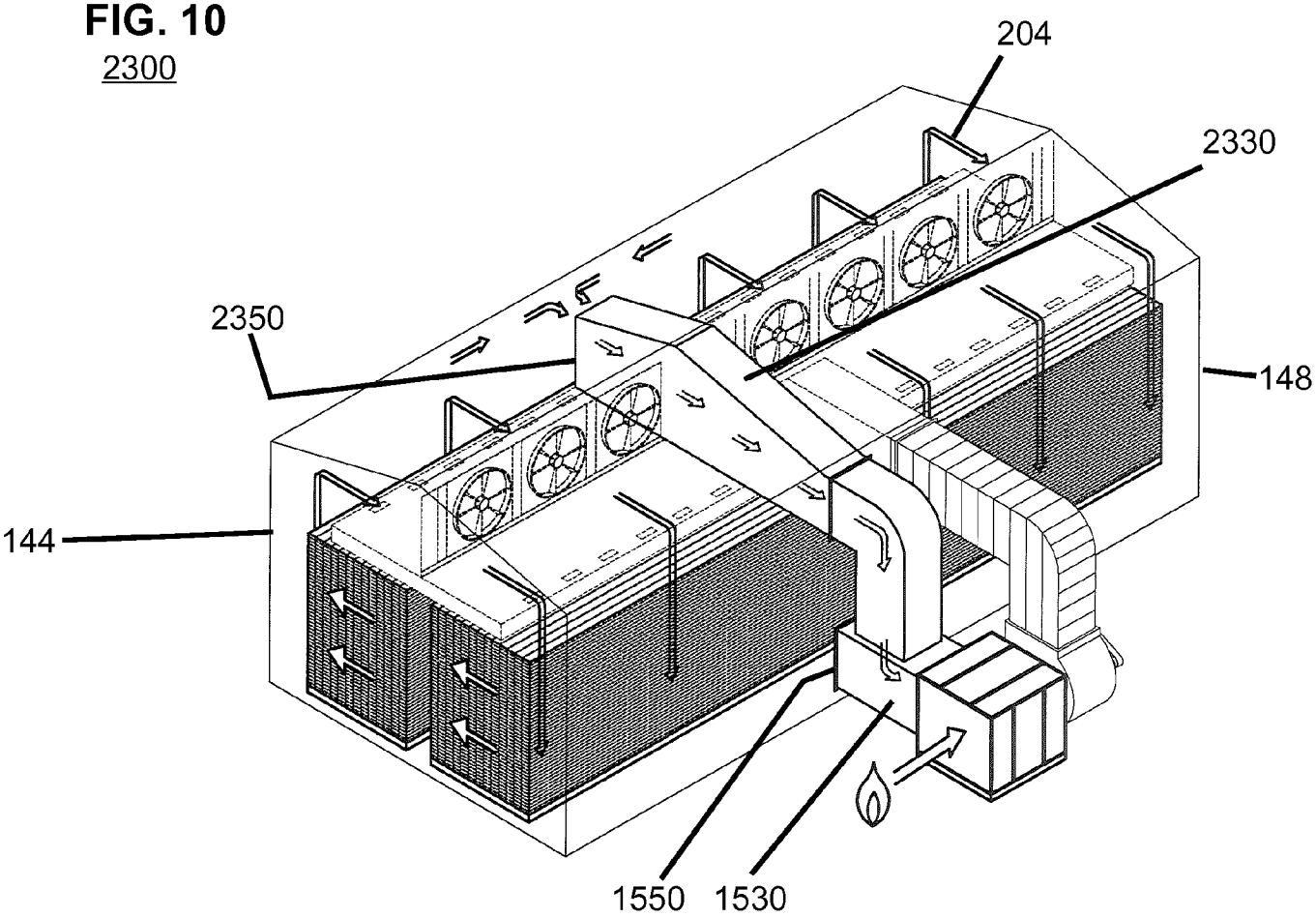
FIG. 10 show a modified main drying section with an internal second return duct as operated with reverse air flow.

FIG. 10 shows internal second return duct 2330 in main drying section 2300 operated in the reverse direction (here 204). Damper operation allows return air to enter opening 2350 rather than opening 1550 to cause return air to travel through internal second return duct 2330 on way to return duct 1530. By controlling the effective size of openings 2350 and 1550, the slight pressure drop from travel through internal second return duct 2330 can be compensated for without resorting to biased settings of the return duct modulating damper so that the pressure substantially match the pressure drop from first side 144 to second side 148 for forward operation to promote both the consistency in treatment for lumber while simplifying burner control.

Figure 11:
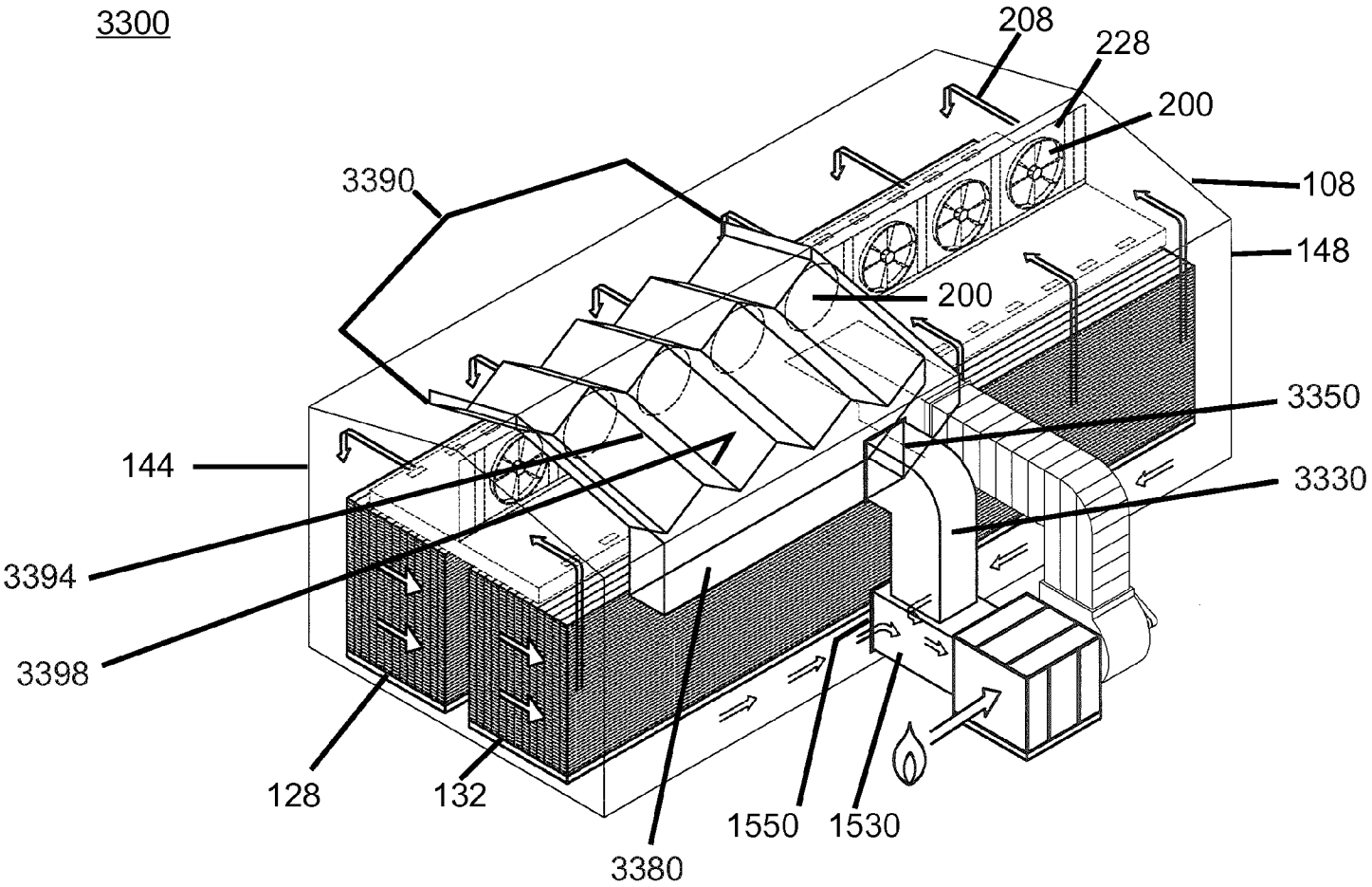
FIG. 11 show another modified main drying section with a W-second return duct as operated with forward air flow.
Figure 12:
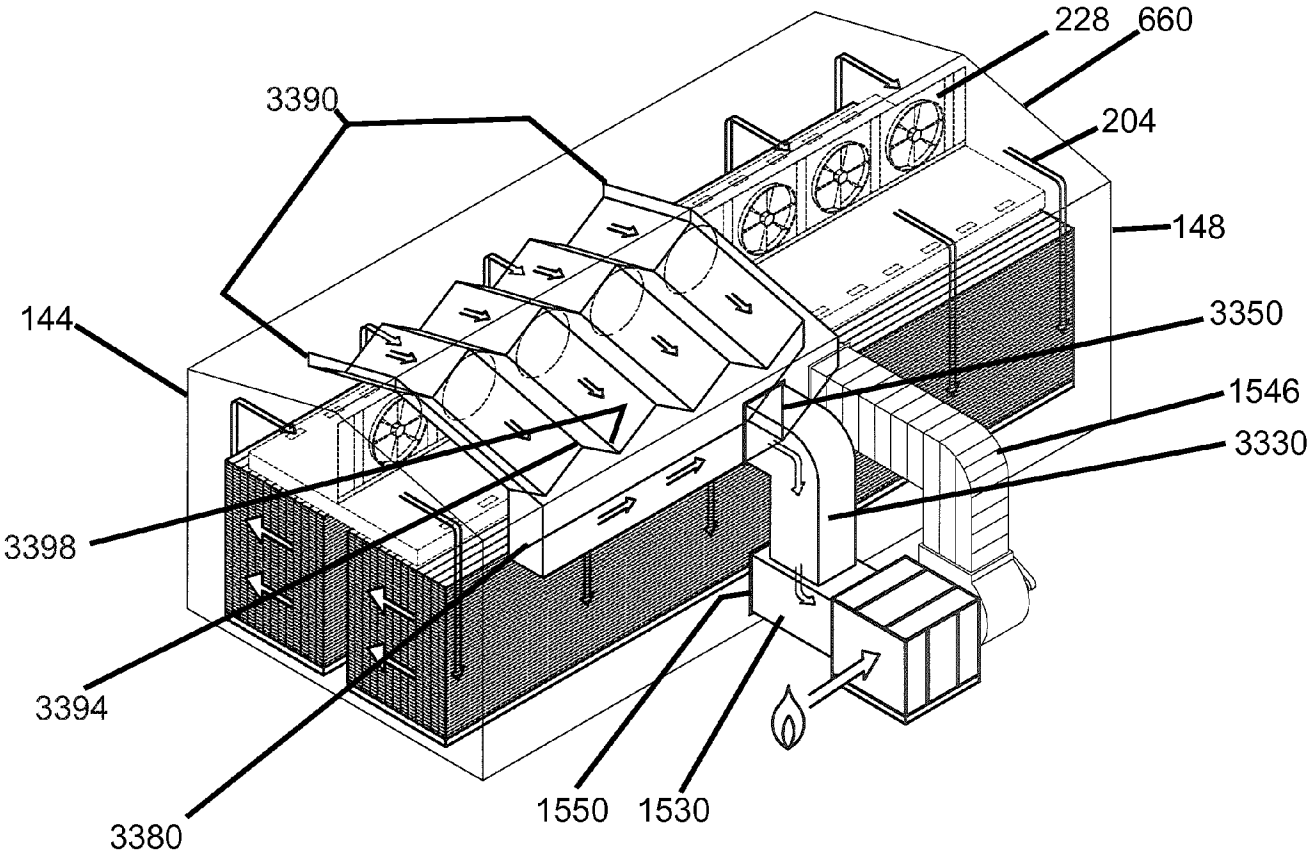
FIG. 12 show another modified main drying section with a W-second return duct as operated with reverse air flow.

FIG. 11 and FIG. 12 show a main drying section 3300 with an alternative to the design described in FIG. 9 and FIG. 10. The design in FIG. 11 has what may be called a W-second return 3390 or alternatively a sawtooth second return. W-second return 3390 has a series of peaks 3394 and valleys 3398 to allow air flow from the first side 144 to the second side 148 over the fans 200 (including the fans shown as circles beneath the W-second return 3390) to allow air to move to second return header 3380 and into second return duct 3330 if damper operation opens opening 3350.

FIG. 11 shows operation in the forward direction (here 208) where damper operation has closed opening 3350 so the return air enters open opening 1530 to supply the supply duct 1530.

FIG. 12 shows operation in the reverse direction (here 204) with dampers operated to open a flow path to opening 3350 to supply return duct 1530 with air that crosses center fan wall 228 via W-second return 3390 between the valleys 3398 and where the peaks 3394 are adjacent roof 660 to supply air flow to return header 3380.

One of skill in the art will appreciate that the large effective cross section of the W-second return 3390 will decrease duct losses for air moving from first side 144 to second return header 3380. Reducing the effective cross section of opening 1550 can help balance the pressure gradient experienced by the lumber so that the pressure gradient between second side 148 and first side 144 for reverse operation can substantially match the pressure drop from first side 144 to second side 148 for forward operation to promote consistency in treatment for lumber.

The W-Second return 3390 can be extended towards the second end 108 or augmented by an additional W-second return (not shown) located on the second end side of supply duct 1546 with another return header (not shown) which can be connected by duct work to second return duct 3330 or return duct 1530 if desired.

The controls for dampers used in a dual return system may be connected together so that the system is precluded from closing both dampers at any one time. The duct selection dampers may either be linked to each other mechanically or by other means. They may be determined to have opposite actions so that only one of the dual return ducts is ever allowed to be open at one time. Alternatively, the duct selection dampers may also be separate and independent, in order to lower pressure in the mixing chamber under certain startup circumstances by receiving return air from both sides of the kiln at the same time.

As the disclosed teachings minimize or eliminate the pressure differences experienced by the change from forward direction to reverse direction, the damper system may focus on the direct fired burner and the mixing chamber.

Figure 13:
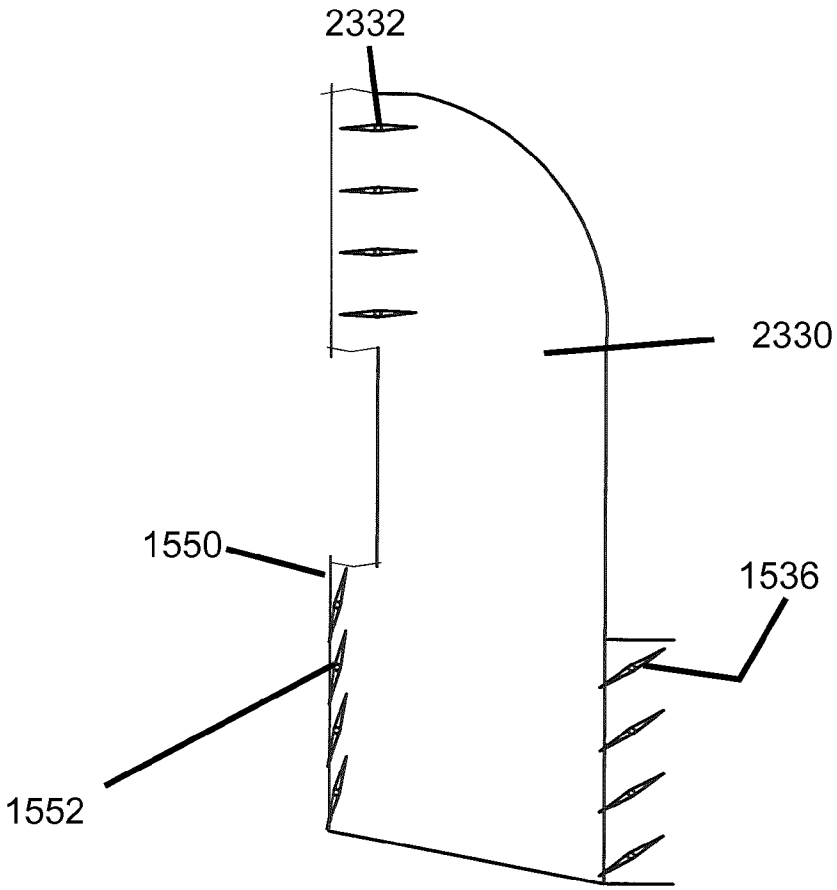
FIG. 13 shows one damper arrangement.

FIG. 13 shows one damper arrangement. Internal second return duct 2330 is regulated by damper 2332 which is normally full open (as shown in FIG. 13) or full closed. The air flow through opening 1550 for the forward fan direction is regulated by damper 1552 which is normally full open or full closed (as shown in FIG. 13). Modulating damper 1536 is used to control the amount of air into the mixing chamber (1538 not shown here). Opening the modulating damper 1536 will decrease the draw on the direct fired burner 1534, and conversely closing the modulating damper 1536 will increase the suction on the direct fired burner 1534. Thus, the modulating damper 1536 alters the ratio of air in the mixing chamber 1538 from the return duct 1530 versus output from the direct fired burner 1534. By providing similar air flow to the modulating damper 1536 under both forward and reverse fan operation, the modulating damper 1536 may be used to control the mixing chamber 1538 rather than partially to compensate for differences in air flow from the forward and reverse fan direction.

Alternatives and Variations

Batch Kilns

The operation of a batch kiln is very much like the operation of a main dryer section except that the thermal treatment starts after carriages loaded with lumber, spacers, and weights are placed in the batch kiln and the carriages are not moved until after the completion of the thermal processing of the lumber, when the carriages are cool enough to be moved and the treated lumber unloaded from the carriages. As batch kilns do not have moving carriages during the heating process, there is not a need for energy recover sections to move heat from heated lumber to green lumber. Thus a batch kiln does not need to have a pair of pathways for carriages. There may be only one carriage pathway, two carriage pathways, or more than two carriage pathways.

As batch kilns operate with a sequence of fan cycles with heated air circulated by fans in a forward direction and fan cycles with heated air circulated by fans in a reverse direction, the teaching of the present disclosure apply equally to batch kilns as the do to continuous drying kiln (CDK) designs.

Differences in Supply.

Figure 4:
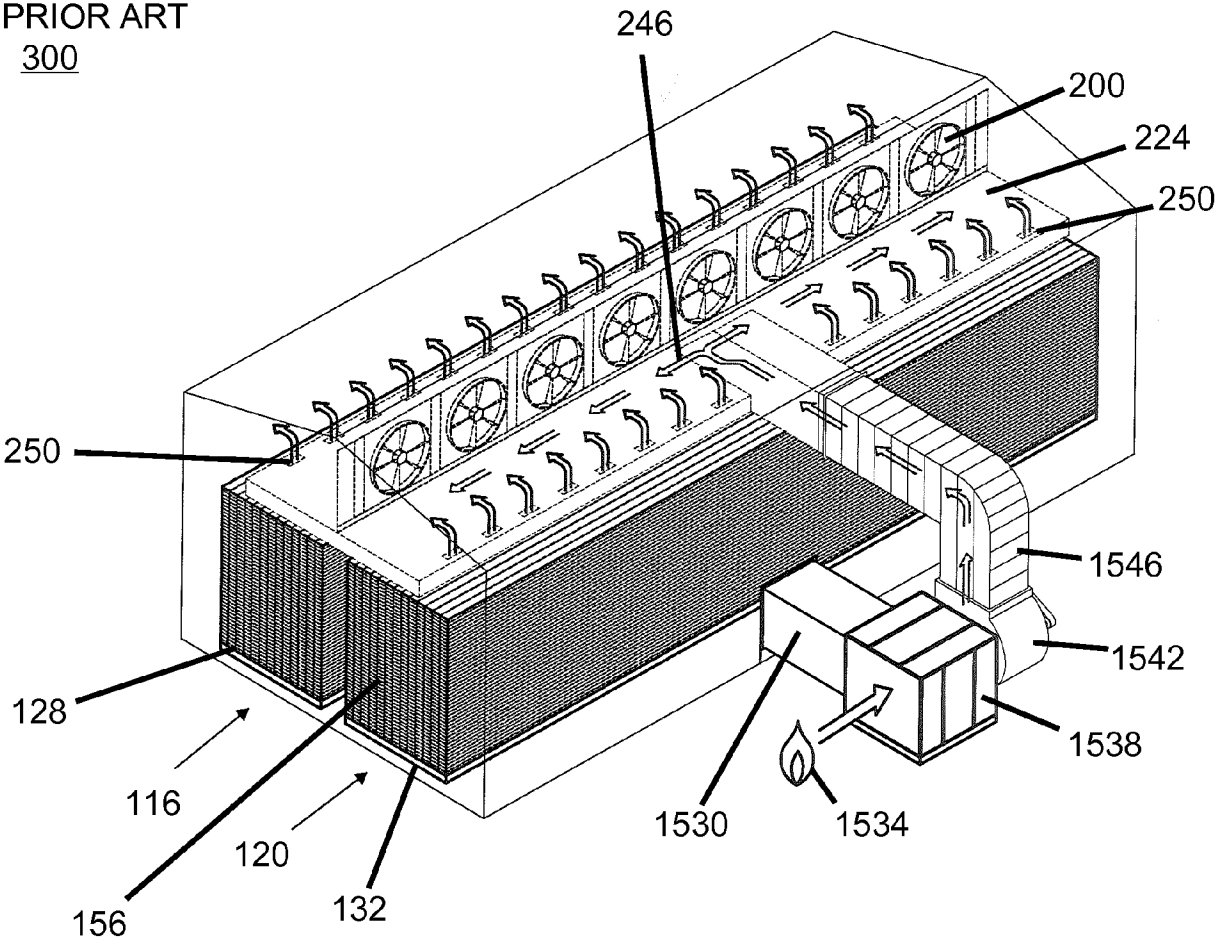
FIG. 4 PRIOR ART
FIG. 4 shows the supply air flow in a prior art direct fired kiln with a combustion heat source.
Figure 5:
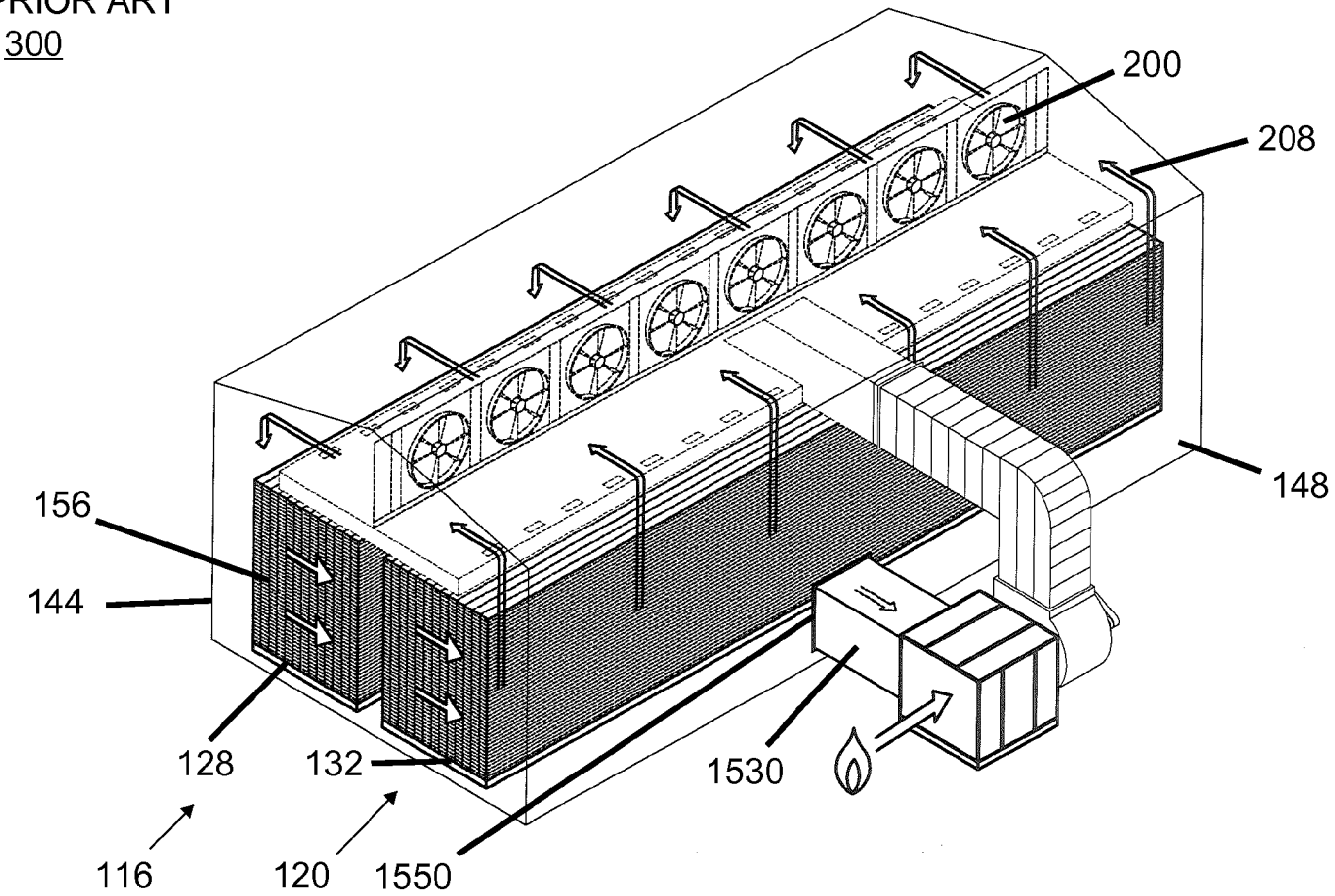
FIG. 5 PRIOR ART
FIG. 5 shows forward air flow in the main drying section of prior art kiln with a single return duct.
Figure 6:
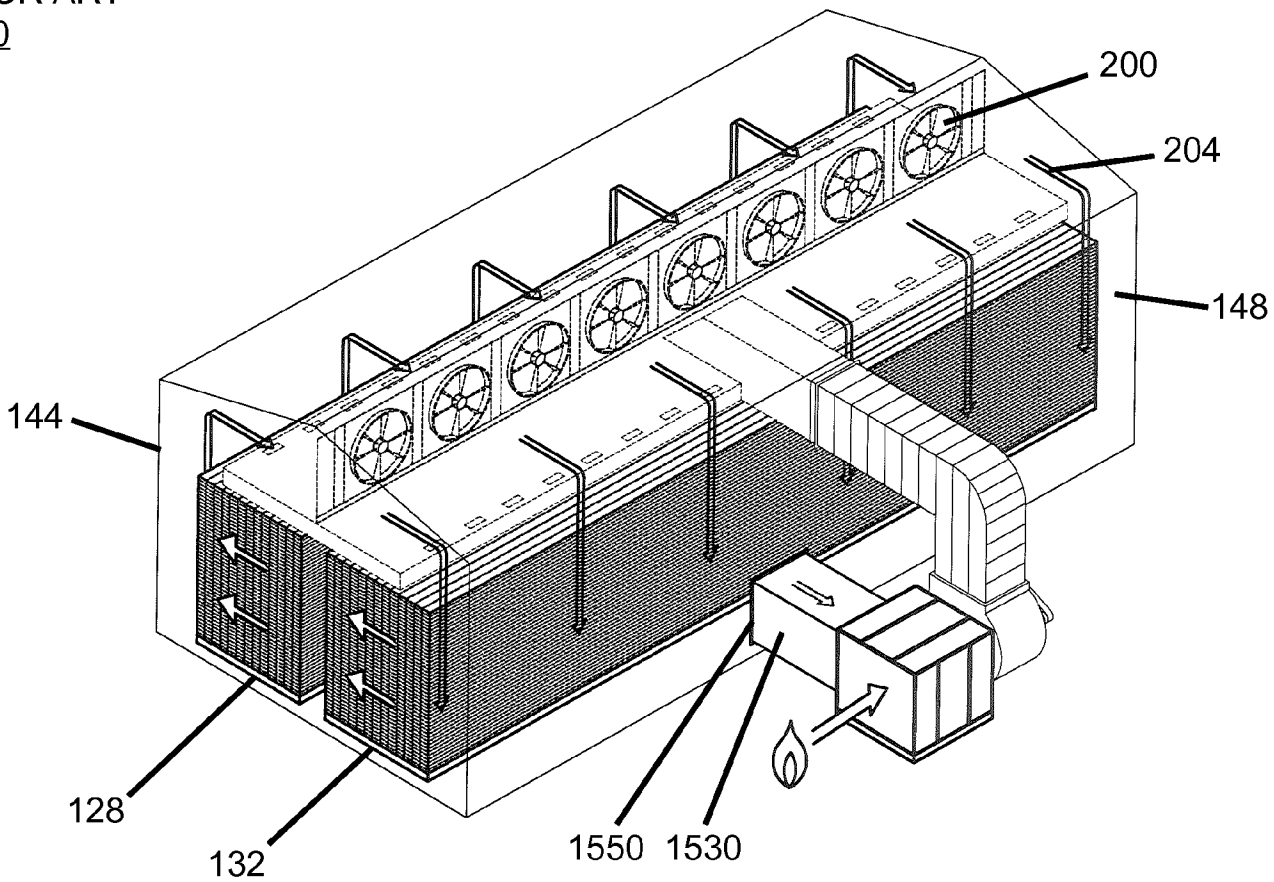
FIG. 6 PRIOR ART
FIG. 6 shows reverse air flow in the main drying section of a prior art kiln with a single return duct.
Figure 7:
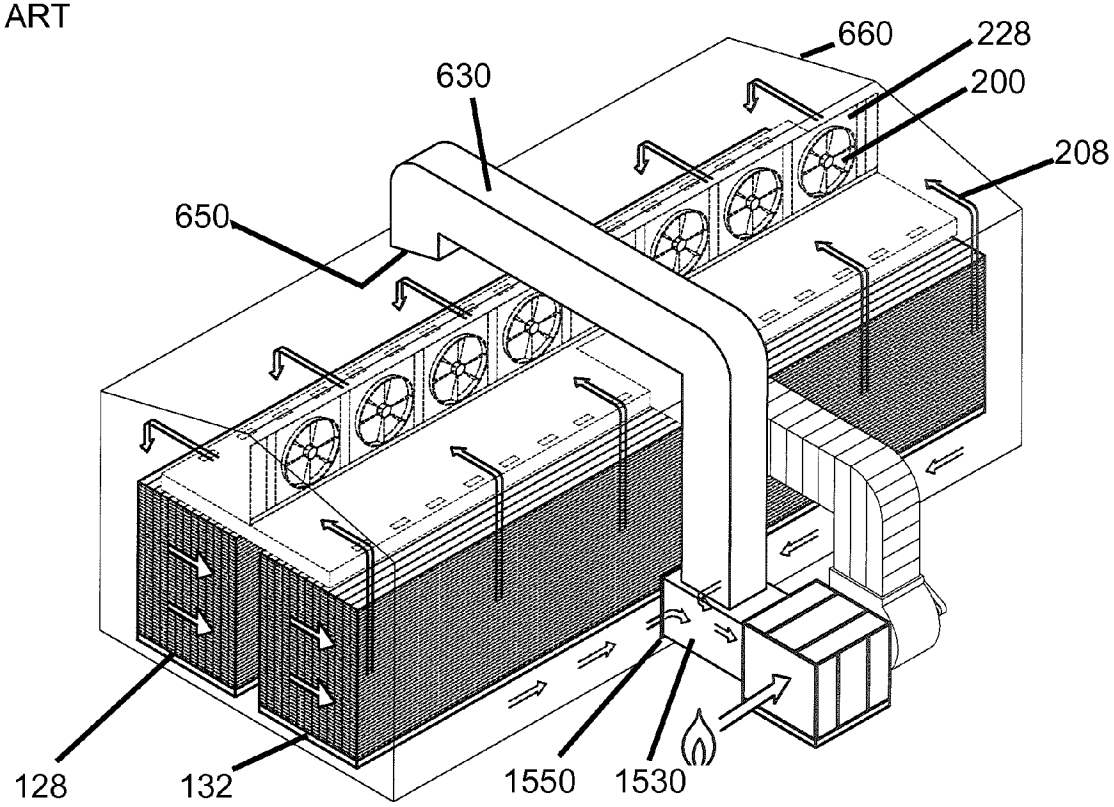
FIG. 7 PRIOR ART
FIG. 7 shows a main drying section of a prior art kiln using an external return duct when operated with forward air flow.
Figure 8:
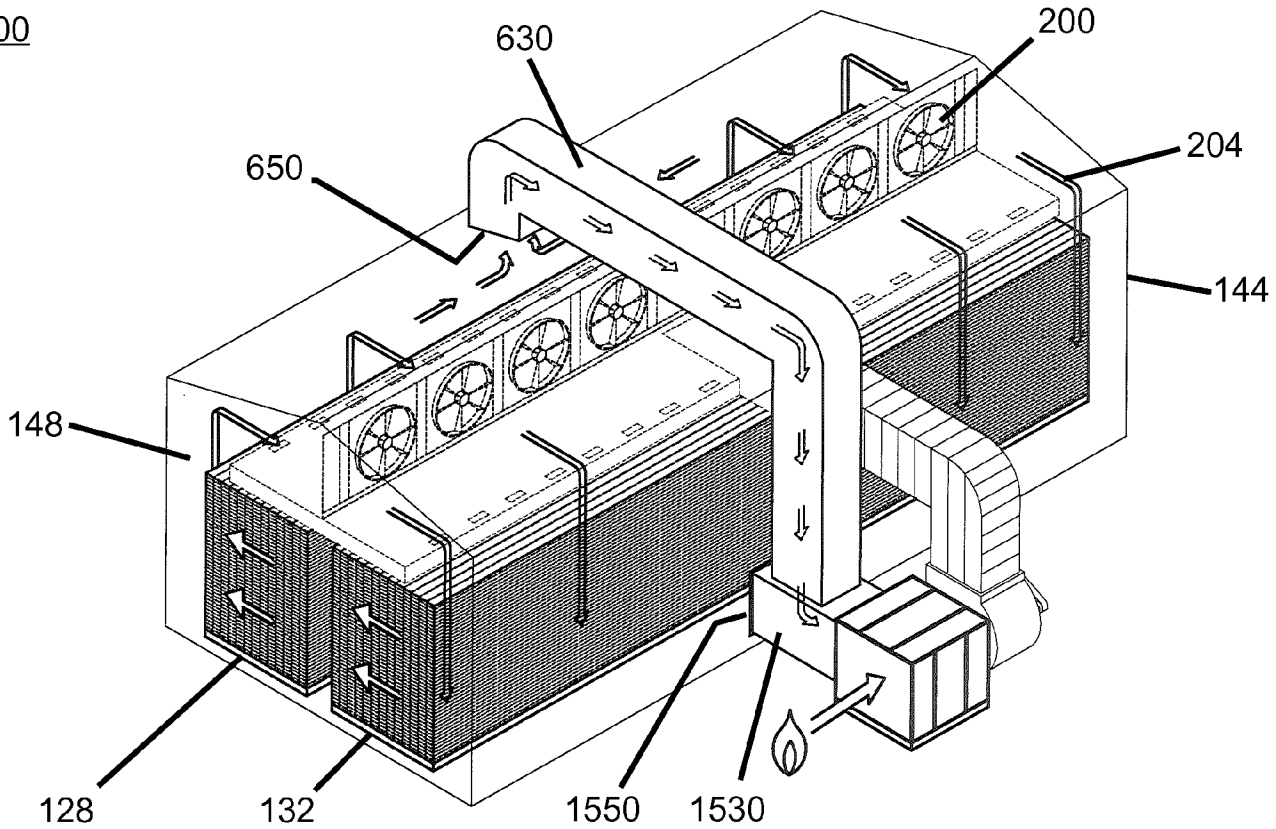
FIG. 8 PRIOR ART
FIG. 8 shows a main drying section of a prior art kiln using an external return duct when operated with reverse air flow.

One of skill in the art will appreciate that the blower 1542 could be placed after duct work rather than directly on the outlet of the mixing chamber 1538 and that the distribution of heated air to the structure may deviate from that described in FIG. 4 while still making use of the in-kiln second return ducts taught with this disclosure.

Differences in Fan Layout.

One of skill in the art will appreciate that one could create forward and reverse air flows using bidirectional fans, two sets of unidirectional fans, unidirectional fans that are rotated from a first orientation to a second orientation, or any other plan to get circulation in the forward and reverse directions while still enjoying the benefits of in-kiln second return air ducts as taught with this disclosure.

Comparison with Conventional Single-Return Duct Architecture.

By consistently drawing return air from the suction side of the kiln in both forward and reverse fan directions, an in-kiln dual return duct in a direct fired kiln will solve the following operational problems.

Conventional single return ducts in a direct fired kiln.

- Return freshly heated air for reheat without this air having been used to dry lumber.
- Use less fuel and deliver less drying energy when operating in reverse fan mode.
- Exhibit lower positive pressure at fan outlets when operating in reverse fan mode.
- Compromise complete combustion and reduce the rate of heat production.
- Compromise return air volume flow rate and reduce the rate of heat delivery
- Reduce efficiency, uniformity, and performance below potential equipment capacity.
- Require that kilns must always be started in the forward fan direction.

Return Freshly Heated Air for Reheat without this Air Having been Used to Dry Lumber.

PROBLEM—During the reverse fan cycle of a kiln with a single return duct, the suction from the recirculating blower is applied to the positive pressure side of the lumber in the kiln. This causes some of the freshly heated air that is coming out of the distribution duct to be drawn directly into the return duct without passing through the lumber. Even if the supply duct temperature is the same in both forward and reverse fan directions, the lumber in the kiln would receive less heat for drying with fans in reverse by the amount of thermal energy carried back to the mixing chamber with this air that is bypassing the lumber. The lumber on the reverse track is especially deprived since less energy is always supplied to the kiln during the cycle when freshly heated air is scheduled to pass first through these stacks of lumber on the reverse track. As a result, not only is less energy delivered to the kiln as a whole during the reverse cycle than would be anticipated if both fan cycles supplied equal heat, but one track of lumber is less well dried than the other track.

IMPROVEMENT—The in-kiln dual return duct system will enable either partial or total exclusion of the positive pressure side of the kiln in either fan direction, and will be capable of exclusively returning only spent kiln air to be reheated.

Use Less Fuel and Deliver Less Drying Energy when Operating in Reverse Fan Mode.

PROBLEM—Warmer air is returned from the kiln during the reverse fan cycle than is returned during the forward cycle. This higher temperature of the air returning to the mixing chamber necessitates that less heat is needed from the burner in order to satisfy the supply duct set point temperature, which is limited in order to protect the mild steel components of the blower and supply duct. Temperature in the supply duct is therefore usually not permitted to exceed 500° F. Consequently, less fuel is introduced to the heating device and less total thermal energy is delivered to the supply duct and to the kiln during the reverse fan cycle. In one example, a kiln rated to produce 30 MM Btu/hr used an average of ½ ton per hour more fuel in forward than it used in the reverse fan direction. This equated to derating the burner output by over 3 MM Btu/hr or a 10% loss in heating capacity during the reverse fan cycle.

IMPROVEMENT—The in-kiln dual return duct system will return air with consistent temperatures for both fan cycles, accepting only spent kiln air into the return air system. This will minimize temperature differences in the return air between forward and reverse fan cycles and promote equal fuel use in both forward and reverse cycles for consistent maximum system performance.

Exhibit Lower Positive Pressure at Fan Outlets when Operating in Reverse Fan Mode.

PROBLEM—Air pressure is lower on the positive pressure side of a single return duct kiln when fans are in reverse mode. In a drying section of a KDS constructed kiln with a single return, the following pairs of concurrent pressure measurements were taken on opposite sides of the kiln, near the center of the kiln, as shown in Table 1 below.

TABLE 1

Center kiln pressures in forward and reverse fan modes.

| Mode | Left Plenum | | Right Plenum | |
|---|---|---|---|---|
| Forward | 0.6 | inches $H_2O$ | −0.3 | inches $H_2O$ |
| Reverse | −0.3 | inches $H_2O$ | 0.4 | inches $H_2O$ |

No pressure loss was noticed from the suction side of the fans in either fan rotation mode, and yet a +0.2 inch water column pressure drop was measured near the return duct with fans in reverse. This reduced positive pressure at the kiln center and proportionally diminished the driving force that was pushing the hot air through the lumber to affect the drying process.

IMPROVEMENT—The in-kiln dual return duct system will prevent imbalance in kiln pressures between fan modes, providing the same positive pressures on alternating side of the kiln during forward and reverse fan cycles.

Compromise Complete Combustion and Reduce the Rate of Heat Production.

PROBLEM—The primary function of the modulating return damper in direct fired kilns with wood fuel burners is to govern the suction pressure inside the combustion chamber of the heating equipment. Control of negative burner inlet pressure regulates the supply of stoichiometric air for complete combustion, which is crucial for optimum system performance. Providing this function through the use of a multi-function return duct damper complicates control, especially when the damper must be used to compensate for shifts between alternating positive and negative return duct inlet pressures from sequential forward and reverse fan cycles.

IMPROVEMENT—Since the in-kiln dual return duct system provides a dedicated duct selection damper to select the source of the return air, the modulating damper function will be more specifically dedicated to control the of suction air to better regulate the heat source.

Compromise Return Air Volume Flow Rate and Reduce the Rate of Heat Delivery.

PROBLEM—The modulating return damper in a kiln with a single return duct is an extremely awkward means of control for regulating the rate of air flow in the return duct. As noted above, when fan modes change from forward to reverse, the air pressure at the entrance to a single return duct will rise from about −0.3 inches of water column suction in forward to +0.4 inch of water column pressure in reverse. In this example, the closure of a single multi-function return damper increased from 50% closed in forward to 70% closed in reverse. The intention for this closure of the return damper was to provide the same volume of air flow in reverse that was being returned to the heating equipment during forward, but control by this method is very imprecise.

IMPROVEMENT—The in-kiln damper system with separate burner pressure modulation and duct selection damper functions, were each may be provided by separate actuators. Furthermore, the use of the duct selection damper to consistently expose the return duct damper to air from the negative side of the kiln will enable the modulating damper to have the same control settings for both fan directions.

Reduce Efficiency, Uniformity, and Performance Below Potential Equipment Capacity.

PROBLEM—Reduction of energy delivered to the kiln during the reverse fan direction, compounded with non-uniform drying between reverse and forward tracks, means reduced drying and reduced uniformity even in lumber batches run at slower process rates. Since fans and blowers require the same power to operate in either fan direction, performance penalties associated with compromised production efficiency cause waste in time, energy, and capital investment.

IMPROVEMENT—The in-kiln dual return duct system will simplify control and correct the causes of pressure and temperature inequality in the process of returning equal volumes of air for reheat in a kiln.

Require that Kilns Must Always be Started in the Forward Fan Direction.

PROBLEM—Following even a brief pause or shut down, kilns with single return ducts must always be restarted in the forward direction in order to avoid any possibility of positive back pressure from the fans being applied to the heating device. Direct fired kilns should never start up in the reverse fan direction. In forward, kiln fans will not pressurize the return duct, and pressurizing the return duct must be avoided on start up in case the recirculation blower might fail or simply be overpowered by fan pressure before it reaches its full operating speed. The necessity of always starting kilns in the forward fan mode contributes to unequal drying whenever a kiln is paused or shut down during a forward fan cycle.

IMPROVEMENT—Dual air return ducts will always draw return air from the low pressure side of the kiln. This will provide an additional safety feature at the same time that it removes the necessity of always starting in the forward fan direction.

Comparison with Overhead or Underground Dual-Return Ducts.

No previous dual return alternative has included plans to penetrate the interior space above the lumber stacks conventionally occupied by the distribution duct and the fan wall. Previous kiln construction has minimized the structural footprint of the kiln while optimizing an unobstructed path for air flow throughout the plenum, between kiln walls and lumber.

Figure 1:
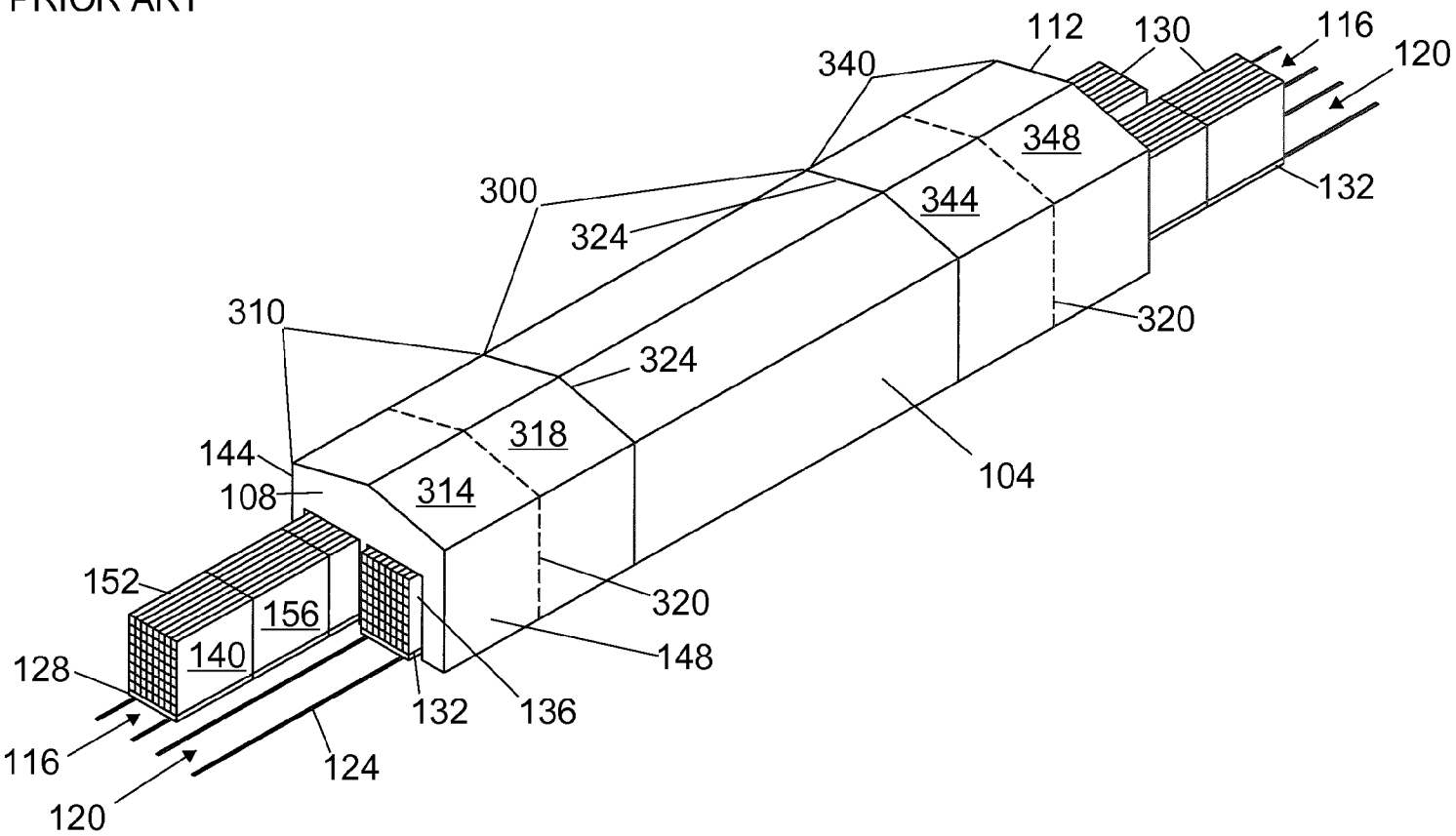
FIG. 1 PRIOR ART
FIG. 1 is a continuous kiln as exists in prior art.
Figure 2:
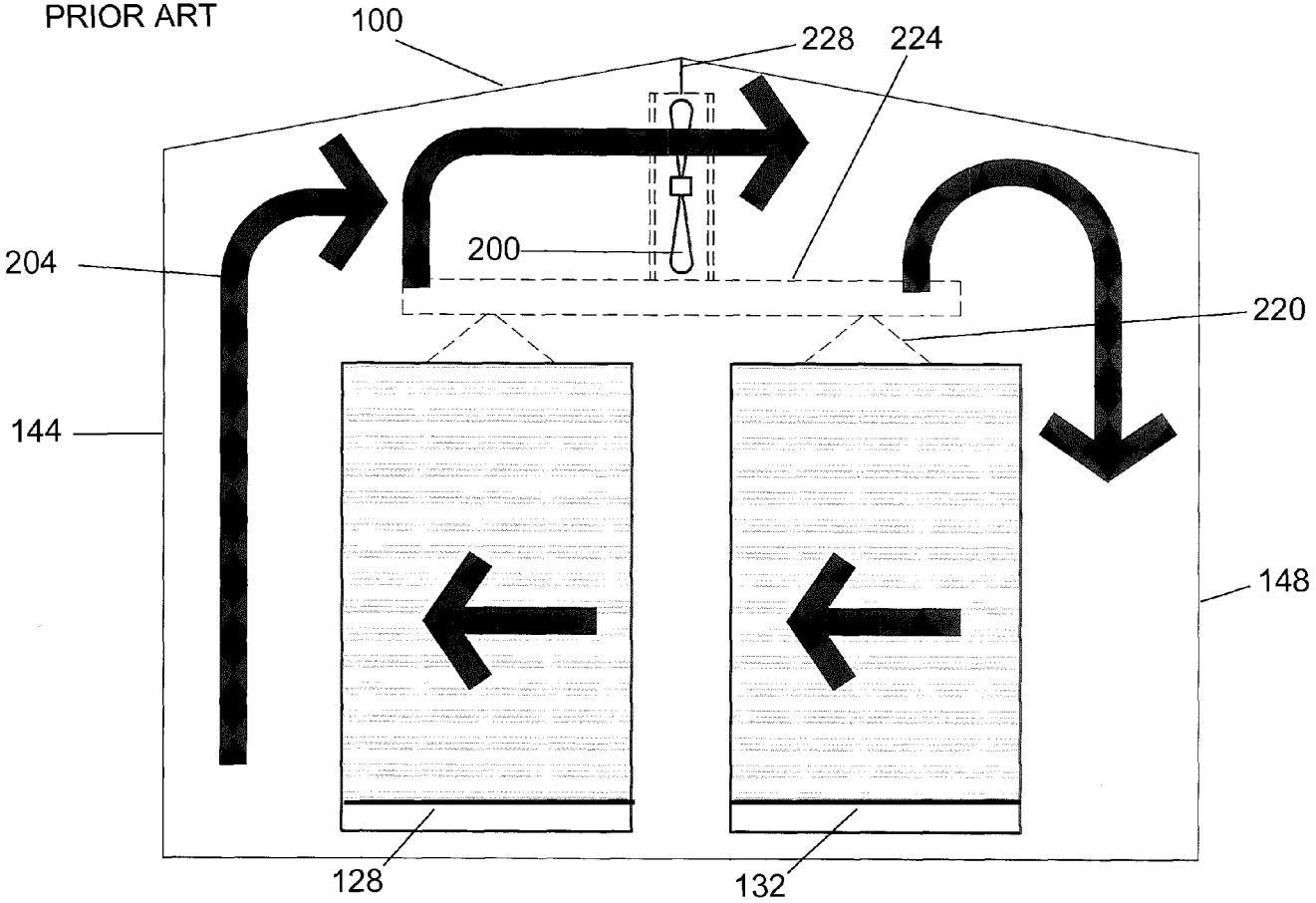
FIG. 2 PRIOR ART
FIG. 2 is a diagram of clockwise rotation of heated air trough lumber stacks
Figure 3:
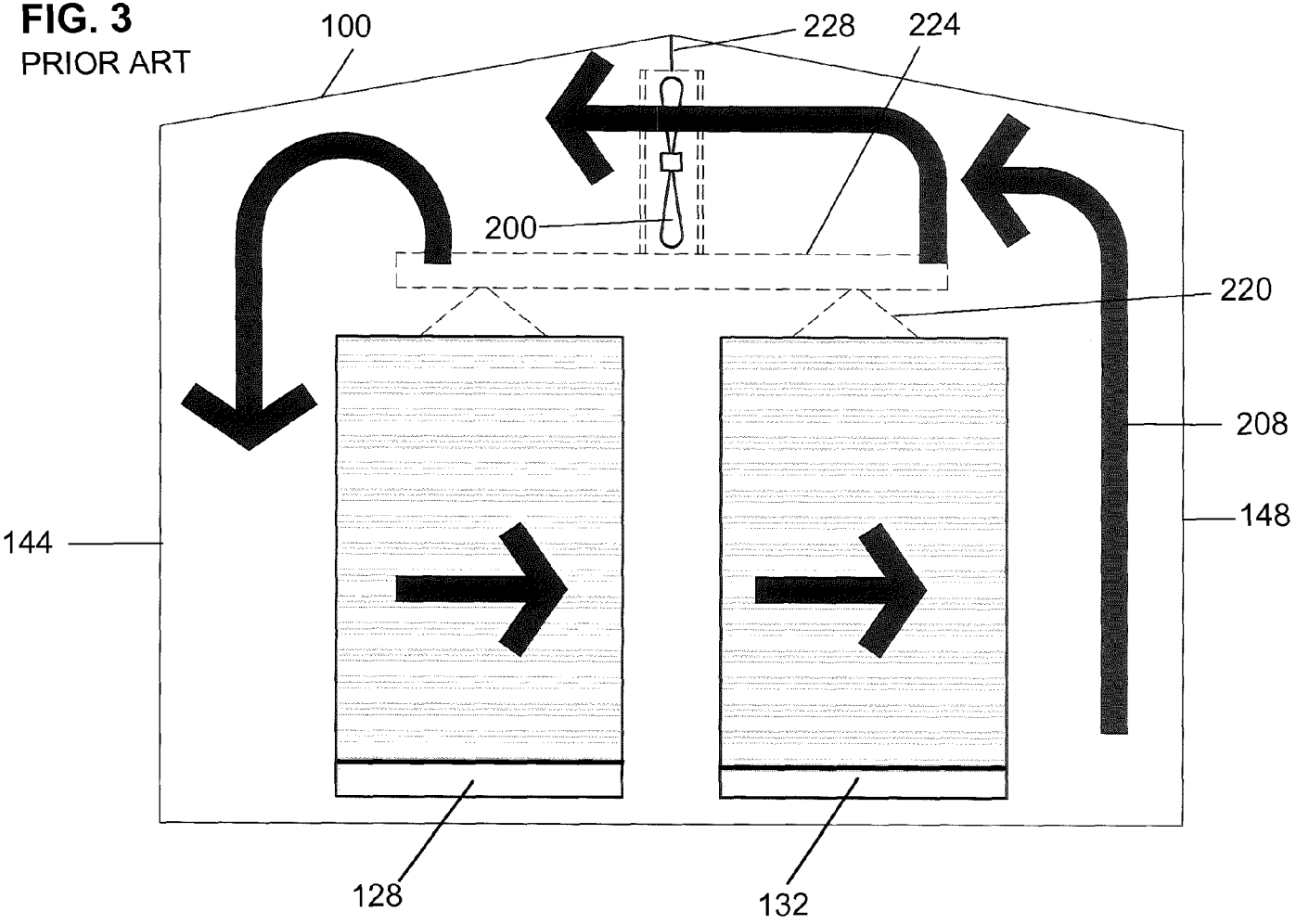
FIG. 3 PRIOR ART
FIG. 3 is a diagram of counter-clockwise rotation of heated air trough lumber stacks.

Lumber kiln design has been an area of recent research and development, as witnessed by U.S. Pat. No. 6,370,792 by George Culp and Robert Nagel, and its extensive list of citations. This patent describes a method of releasing heated air from raised ducts extending upward out of the distribution duct into the discharge side of each kiln fan. In paragraph 26, under the heading of 'Detailed description of the invention,' the authors refer to an overhead return air duct that is explicitly external to the kiln. George Culp's external return air duct was "mounted to the roof" of the kiln as shown in FIG. 2 of U.S. Pat. No. 6,370,792.

Returning kiln air to the mixing chamber of a direct fired kiln heating system through apertures in or around the fan wall, as proposed herein, has not previously been considered by those skilled in the art of kiln design. Reasons for this omission may include challenges experienced in providing uniform heat distribution along the length of lumber kilns. Another reason may result from the concentration of efforts directed toward the design of 'vortex splitters', and similar vanes and baffles intended to smooth out irregularities in the flow of fan driven air. These concerns may be addressed through balancing the air pressure on each side of kiln lumber stacks between the middle and ends of a kiln as well as between opposite sides of the lumber at any given point along the length of the kiln.

Underground return ducts have been tried in a variety of forms. Underground passageways were previously used in earlier steam kiln designs, historically placing recirculating fans or blowers below ground level underneath the stacks of lumber. Underground return ducts are subject to condensation which leads to corrosion and fowling of the underground passages. Building underground can also drive up the costs of construction given the need for overhead support of heavily loaded trucks of lumber to transit from one end of the kiln to the other.

External overhead or underground dual return air duct kiln systems:

Promote condensation or fowling,

Cost more to construct,

Require greater fuel use in the reverse fan direction,

Produce slower drying rates in the reverse fan direction,

Produce less uniform drying at maximum kiln heating capacity,

Lack extra safety features associated with the proposed in-kiln method, and

Are less economical to retrofit, especially on batch kilns (See claims 5, 6, & 7).

Promote Condensation or Fowling.

PROBLEM—Condensation has plagued overhead return ducts and fowling has hindered underground returns to such an extent that neither design is currently considered for new kiln construction. Six underground return ducts were built in tunnels under the track rails of one company's direct fired kilns, but this design was discontinued due to high maintenance costs of ash and water accumulation. One overhead roof-penetrating duct (discussed above) was built in 2001, but this configuration was never reproduced due to severe condensation leading to corrosion and eventual collapse of the duct.

IMPROVEMENT—The in-kiln dual return duct for reheating air in reverse is located inside the heated portion of the kiln. Keeping the return duct inside the heated kiln and above the level of the lumber will minimize condensation and reduce the fowling encountered underground.

Cost More to Construct.

PROBLEM—Constriction costs for return ducts are proportional to their relatively large size. Standard return ducts in direct fired kilns range from 5 ft.×7 ft. to 6 ft.×8 ft. with corresponding duct cross sectional areas between 35 and 48 square feet. Underground ducts of these dimensions require substantial excavation and reinforced concrete to support the rails, carriages, and weight covered lumber stacks which must pass above them. This movement of heavy carriages (sometimes called trollies or carts) and stacks of lumber is increased in a continuous drying kiln or CDK. Overhead return ducts that are outside of the kiln need to be insulated, supported, and constructed of sufficiently heavy materials to withstand storm velocity wind loads.

IMPROVEMENT—The in-kiln dual return duct system will not require wind load support or insulation for any length of return duct that is located inside the kiln. This system will also require a minimum duct length, extending only from the forward edge of the distribution duct through the kiln wall closest to the burner. Internal kiln location and minimum duct length will reduce the cost of construction in comparison to overhead or underground systems.

Require Greater Fuel Use in the Reverse Fan Direction.

PROBLEM—Greater fuel use would be expected in the reverse fan mode for a kiln with dual overhead or underground returns due to temperature losses from large external exposed ductwork. An external overhead duct on a kiln that was 34 ft. wide and 26 ft. high at the roof peak would be likely to lose the equivalent amount of heat through the overhead return duct as would be lost from of conventional single-return kilns without a duel return adaptation. If 25% of the air that enters the mixing chamber is supplied by an overhead return duct, and if this air flow loses 60° F. temperatures (1° F. per ft external duct length) especially during extreme winter weather, then the external return duct might lose 4 MM Btu per hr. Heat lost to the environment, whether to the ground or surrounding ambient air, is thermal energy lost from the system that would need to be replaced by increasing the output from the heating system during the reverse fan direction.

IMPROVEMENT—The in-kiln dual return duct is designed to minimize temperature lost from kiln air being returned to the mixing chamber to be reheated.

Slower Drying Rates Result from Lower Kiln Efficiency.

PROBLEM—While overhead and underground return ducts compensate for heat and pressure losses in reverse, they both incur temperature and pressure penalties from longer return duct lengths.

IMPROVEMENT—By minimizing the length of the reverse return duct and providing adequate duct cross sectional area, in-kiln dual returns minimize temperature and pressure lost to friction or heat transfer through a long conduit. Therefore, the difference in drying capacity at peak burner production can be maintained at nearly the same levels in both forward and reverse.

Produce Less Uniform Drying at Maximum Kiln Heating Capacity.

PROBLEM—Kilns with overhead or underground dual return ducts will produce less uniformly dried lumber if consistently operated at their maximum rated capacity as set by performance in the forward fan direction. Uniformity in finished lumber moisture content is the primary goal of kiln operation. Most kiln dried lumber is specified to finish with 13% moisture content by weight. The reversal of fan directions is intended to make sure that both tracks of lumber in a two track kiln are exposed to the same proportion of freshly heated air for equal periods of time. The loss of pressure and temperature through longer overhead and underground ducts will limit the maximum uniform drying capacity of the kiln to the performance with the longest path for return air in the reverse fan direction.

IMPROVEMENT—The objective of the proposed in-kiln return dual return system described in this disclosure is to minimize the return path of air being extracted from the kiln for re-heat in the mixing chamber. The shorter length of in-kiln return ducts, compared to overhead or underground ducts, will minimize temperature and pressure loss through the return duct system.

Lack Extra Safety Features Associated with the Proposed In-Kiln Method.

PROBLEM—Safety is a major concern for all dry kilns and has been thoroughly considered for preceding overhead and underground dual return duct designs.

SOLUTION—The in-kiln dual return duct system includes a modulating damper that retains an open area of at least 30% of the recirculating blower intake area at the end of its closure rotation. This ensures that the no more than 70% of the blower suction will be applied to the heating equipment, which might implode refractory lined ducts or otherwise compromise the integrity and safe operation of combustion devices if exposed to the full suction of the blower. The duct selection damper will enable the modulating damper to be used exclusively for control of suction on the combustion device. Duct selection dampers can act dependently or independently. Dependent actuation can be achieved mechanically or by means of linking pneumatic or electronic control actuators. Independent actuation could enable blending access to both sides of the kiln, potentially to increase the total volume of air returned for reheating.

Are Less Economical to Retrofit, Especially on Batch Kilns

PROBLEM—Neither overhead nor underground double return duct designs are economical to retrofit to pre-existing kilns with single return duct architecture.

IMPROVEMENT—Simplified dual return duct designs that penetrate the fan wall with minimal restriction to the flow of recirculating kiln air can be used to significantly improve the productivity of existing kilns. Compromise methods, such as the saw-tooth ceiling duct described in the claims of this disclosure, enable older facilities to be upgraded to achieve most of the benefits of more efficient lumber drying at far lower cost of implementation.

SUMMARY AND CONCLUSION

Both overhead and underground return duct designs have been built in attempts to resolve the lumber drying discrepancies between forward and reverse fan directions, but neither of these methods is currently used in new construction. The in-kiln method for fan wall penetration of this disclosure is fundamentally different from these earlier methods because it provides a shorter duct path with less heat loss. It is accomplished by balancing the positive pressure distributions between fan directions on both sides of lumber stacks in a kiln, with emphasis on minimizing horizontal pressure gradients along the length or the kiln.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Other systems, methods, features and advantages of the disclosed teachings will be or will become apparent to one with skill in the art upon examination of the following figures and detailed description. Moreover, the scope of the claims which follow covers the range of variations, modifications, and substitutes for the components described herein as would be known to those of skill in the art.

That is claimed:

1. A method of operation of a kiln duct system for a system for balancing the return air flow in a direct fired lumber kiln between forward and reverse fan directions that employs a pair of return air ducts, wherein the return duct used for reverse flow operation carries return air within a heated space of the kiln that is located above lumber stacks in the kiln; where this reverse flow return duct carries return air from a low pressure side of the kiln on a distal side of the lumber stacks to a proximal side of the lumber stacks closer to a mixing chamber located outside of the kiln to mix burner exhaust with return air; and the return air flows during both forward and reverse fan cycles leave the heated space of the kiln to enter the mixing chamber through ducts located on the side of the kiln adjacent to the mixing chamber.

2. The method of operation of the kiln duct system of claim 1 to balance mass flow rates of return air by selecting one of the pair of return ducts that draws air from a negative pressure side of the kiln.

3. The method of operation of the kiln duct system of claim 1 to balance pressures on opposite sides of the lumber in the kiln by selecting one of the pair of return ducts that draws air from a negative pressure side of the kiln.

4. The method of operation of the kiln duct system of claim 1 using control through either manual controls or an automatic control system to increase or decrease a suction pressure on a combustion heat source by adjusting a modulating damper that is not also used to compensate for pressure variation caused by return duct pressure differences between forward and reverse fan directions.

5. The method of operation of the kiln duct system of claim 1 to produce more equally dry lumber on both forward and reverse lumber tracks of the kiln during equally efficient sequential forward and reverse drying cycles.

6. The method of operation of the kiln duct system of claim 1 to balance return air flows by always selecting one of the pair of return ducts that at least partially draws air from a negative pressure side of the kiln.

7. The method of operation of the kiln duct system of claim 1 to increase a total volume of air recirculated by selecting some portion of the return air from both sides of the kiln to increase a total thermal energy delivered for lumber drying.

8. The method of operation of the kiln duct system of claim 1 to balance pressure in the return air between forward and reverse fan directions such that a total suction pressure in the mixing chamber will be consistent during both kiln fan directions.

9. The method of operation of the kiln duct system of claim 1 to improve reliability and operating consistency of a combustion heat source device by increasing the consistency and manageability of a suction pressure drawing heat from this device during both forward and reverse fan direction cycles.

10. A system for balancing the return air flow in a direct fired lumber kiln between forward and reverse fan directions that employs dual return air ducts one return duct for use in the forward fan direction and one return duct for use in the reverse fan direction, the dual return ducts connected to a mixing chamber located outside of the kiln which mixes burner exhaust with return air from the kiln, wherein a reverse flow return duct used for reverse flow operation carries return air within a heated space of the kiln that is located above a set of lumber stacks in the kiln; where this reverse flow return duct carries return air from a low pressure side of the kiln on a distal side of the set of lumber stacks to a proximal side of the lumber stacks closer to a mixing chamber; and the return air flows during both forward and reverse fan cycles leave an interior of the kiln to enter the mixing chamber through ducts located on the side of the kiln adjacent to the mixing chamber.

11. The system of claim 10 in which the reverse flow return duct penetrates a fan wall located over a hot air distribution duct by occupying a space within the fan wall approximating a space occupied within the fan wall by one fan.

12. The system of claim 11 in which power, number of blades or blade angle is adjusted to increase the air flow for each remaining fan.

13. The system of claim 10 in which the reverse flow return duct penetrates a fan wall located over a hot air distribution duct by passing between two fans in the fan wall.

14. The system of claim 10 in which the reverse flow return duct penetrates a fan wall in a series of least two openings to conduct return air between adjacent pairs of fans in the fan wall.

15. The system of claim 10 in which the return air duct passes over a fan wall without leaving the heated space of the kiln.

16. The system of claim 10 in which the return air duct for the reverse fan direction is reduced in size and used only to partially balance the return air.

17. The system of claim 10 in which a hot air supply duct is split into two or more separate supply ducts, such that the hot air supply duct can be divided into separate sections extending over shorter distances along a length of the lumber kiln; with this subdivision of the hot air supply duct then being used to create at least one space above the lumber for the return duct to pass over the lumber within the space normally occupied by a continuous hot air distribution duct in a drying section of the lumber kiln.

18. A kiln duct system described in claim 10 that contains one modulating damper that provides restriction to a flow of return air flow before return air enters the mixing chamber, and this modulating damper closes in order to proportionally raise supply duct temperature or kiln dry bulb air temperature and modulates in order to balance an amount of return air against an amount of suction pressure applied to a combustion heat source.

19. A kiln duct system described in claim 10 that contains a duct selection damper which may be used to exclusively select return air to flow from either the forward or reverse zones of the kiln.

20. A duct selection damper system as described in claim 19 that operates two dampers in separate return ducts, where these dampers are linked to perform opposite opening or closing actions on each duct.

21. A kiln duct system described in claim 10 that contains a duct selection damper capable of independent control for accessing a flow of return air from either side of the kiln or may select portions of return air form both sides of the kiln at one time.

22. A duct selection damper system as described in claim 21 that is comprised of two independent dampers in separate return ducts.

23. A method of operation of a kiln duct system for a system for balancing the return air flow in a direct fired lumber kiln between forward and reverse fan directions that employs a pair of return air ducts, wherein the return duct used for reverse flow operation carries return air within a heated space of the kiln that is located above lumber stacks in the kiln; where this reverse flow return duct carries return air from a low pressure side of the kiln on a distal side of the lumber stacks to a proximal side of the lumber stacks closer to a mixing chamber; and the return air flows during both forward and reverse fan cycles leave the heated space of the kiln to enter the mixing chamber through ducts located on the side of the kiln adjacent to the mixing chamber;

wherein the method maintains a set point temperature in the return duct of the kiln such that this temperature will be consistent between forward and reversed fan directions by selecting one of the pair of return ducts that draws air from a negative pressure side of the kiln.

24. A system for circulating heated air to treat lumber, the system comprising:

a structure having a floor, a roof above the floor, a first end and a second end with at least the first end having an opening so that lumber may be moved into and out of the structure so that stacks of spaced lumber may be treated, a first wall along a first side extending from the first end to the second end, and a second wall along a second side opposite from the first side;

a combustion heat source which provides burner exhaust to a mixing chamber located external to the structure which provides heated air to the structure though use of a supply duct and a blower;

a set of at least one circulating fan located in a fan wall located above a horizontal fan deck and below the roof;

the fan wall separating a proximal side which is proximal to the mixing chamber and a distal side which is on an opposite side of the fan wall;

a proximal side damper used to control a provision of proximal return air taken from the proximal side of the fan wall and provided to the mixing chamber; and a distal side damper used to control a provision of distal return air from the distal side of the fan wall through a distal side duct to the mixing chamber with at least a portion of the distal side duct located above the horizontal fan deck and below the roof, and the distal side duct remaining above the horizontal fan deck and below the roof at least until crossing from the distal side of the fan wall to the proximal side of the fan wall.

25. The system of claim 24 wherein the system is a main drying section of a continuous drying kiln with a first pathway for allowing carriages with stacks of spaced lumber to enter the first end of the structure and exit the second end of the structure and a second pathway for allowing carriages with stacks of spaced lumber to enter the second end of the structure and exit the first end of the structure; and baffles limit longitudinal air flow from the main drying section to a pair of adjacent energy recovery sections.

26. The system of claim 24 wherein all lumber enters the first end of the structure and exits after treatment through the second end of the structure.

27. The system of claim 24 wherein the system is a batch kiln.

28. The system of claim 24 wherein the proximal side damper and distal side damper are precluded from being closed at one time.

* * * * *